United States Patent [19]

Greene, Jr.

[11] 4,381,821

[45] May 3, 1983

[54] BLAST JOINT AND PROTECTION ELEMENT THEREFOR

[75] Inventor: George J. Greene, Jr., Houston, Tex.

[73] Assignee: Weatherford, Stonebor, Inc., Houston, Tex.

[21] Appl. No.: 238,988

[22] Filed: Feb. 27, 1981

[30] Foreign Application Priority Data

Feb. 29, 1980 [DE] Fed. Rep. of Germany ..... 3007788

[51] Int. Cl.[3] ..... E21B 17/02

[52] U.S. Cl. ..... 166/243; 175/325; 138/166; 308/4 A

[58] Field of Search ..... 166/243, 242; 175/325; 138/166, 162, 159, 110; 308/4 A

[56] References Cited

U.S. PATENT DOCUMENTS 3,126,035 3/1964 Espetvedt ..... 138/166

4,141,386 2/1979 Bergstrom ..... 166/243 X

FOREIGN PATENT DOCUMENTS 523618 7/1940 United Kingdom ..... 166/242

*Primary Examiner*—Ernest R. Purser

*Assistant Examiner*—Thuy M. Bui

*Attorney, Agent, or Firm*—Vinson & Elkins

[57] ABSTRACT

A protection structure for a tubular member, such as a blast joint, and a protection element therefore which is an abrasion resistant half sleeve with an inward facing tongue and groove along one axial edge, an outward facing tongue and groove along the other axial edge, a groove in one arcuate end and a projection on the other arcuate end, two of said elements forming a protection ring and a plurality of said rings being supported on a tubular member by upper and lower supports which provide tongue and groove engagement with the upper end of the upper ring and with the lower end of the lower ring.

21 Claims, 6 Drawing Figures

FIG. 3
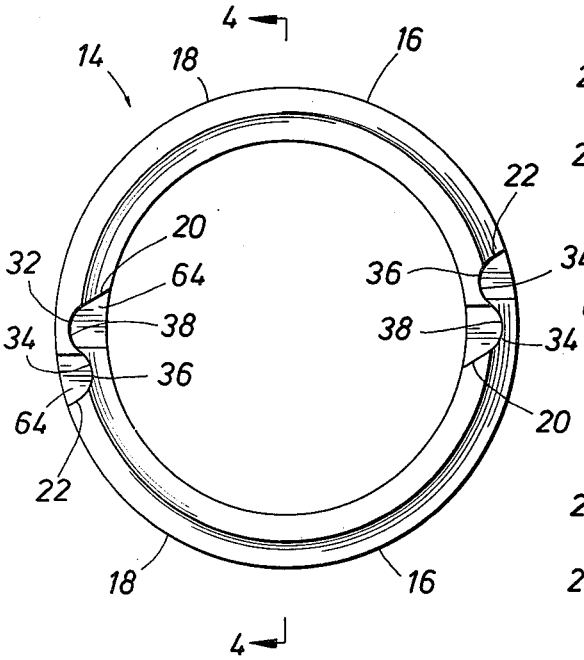
FIG. 4
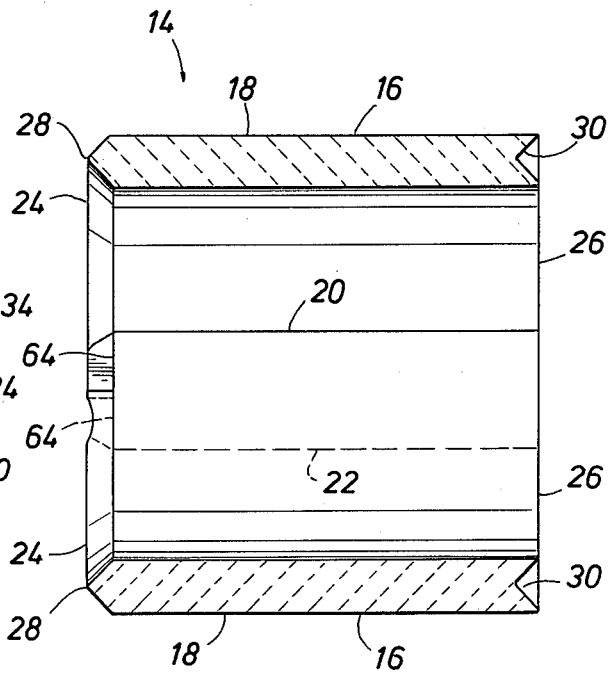
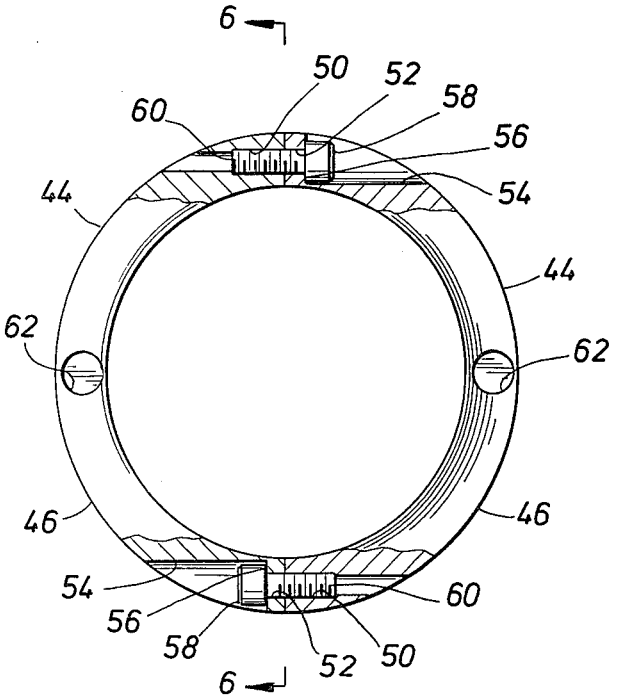
FIG. 5
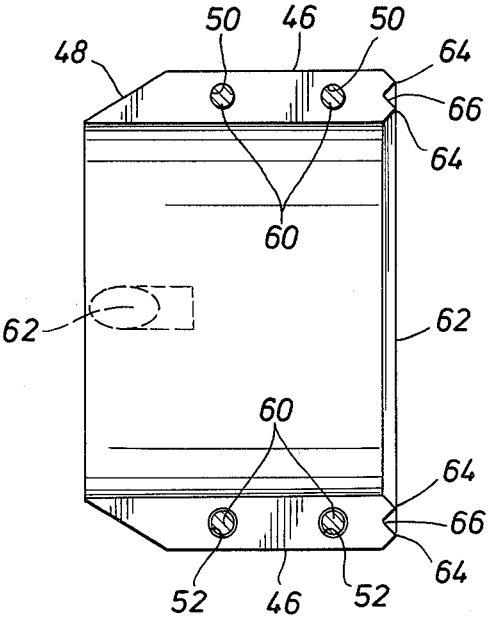
FIG. 6

BLAST JOINT AND PROTECTION ELEMENT THEREFOR

BACKGROUND

Many oil and gas wells produce from two or more producing formations and have a separate string of production tubing for each formation produced. Many times the flow into the well bore, particularly in formations producing high pressure gas, is at high velocities and such streams impinging on the production tubing from a lower formation are extremely abrasive. Such production can erode a tubing string within relatively short periods of time and thereby provide undesired direct communication between producing formations. Such communication can prevent production from one of the formations and may result in thieving from the other.

Many different efforts have been made to solve this problem. U.S. Pat. No. 3,034,912 suggests multiple loose fitting rings of steel or plastic with projections thereof and surrounding the production tubing in the area of the formation performations to protect it from the abrasive action of the production streams impinging thereof. Such rings are proposed to be made of polyethylene or steel and rotate responsive to the streams impinging thereon to eliminate abrasion of the tubing. Such rings have not eliminated this type of abrasion and because of the necessity of the loose fitting of the rings could allow flow to impinge the tubing between the rings.

U.S. Pat. No. 3,365,000 discloses the use of a series of protective shields with a spring embedded in each shield to move the ring outward into the well bore when the protective shield is worn by the inflowing jets to allow the next higher shield to drop into protecting position. Such device admittedly only delays the erosion of the production tubing.

U.S. Pat. Nos. 4,141,386 and 4,028,796 suggest that this problem can be solved by surrounding the production tubing in the area of the upper formation perforations with an extended series of short cylindrical rings of cemented tungsten carbide. The same inventor in U.S. Pat. No. 4,211,440 claims that the practical solution in using such cemented tungsten carbide rings includes the introduction of a resilient biasing of the rings to allow freedom of movement of the rings relative to the tubing to permit handling and moving of the assembled joint without damage to the rings. These structures also wear since the cement matrix does not have the abrasion resistance that the tungsten carbide particles have. The rings when worn may break and fall into the well bore which can render subsequent movement of the production string difficult. Also, because of the flat abutment between rings high velocity jets can cut the tubing string through such abutments when aligned therewith. While stated by the patentee to be a commercial structure, the blast joint in use has not prevented damage to the tubing string.

Interconnecting heat insulation sheathing tiles have been proposed for pipes extending through furnaces as shown in U.S. Pat. Nos. 3,488,040 and 3,914,100. However, such structures are not suitable in a blast joint and they do not suggest the protective end rings and the arcuate interconnection between rings.

SUMMARY

The present invention is directed to an improved abrasion resistant tubular structure, such as a blast joint and to the improved abrasion resistant elements which protect the tubing without having any joints which could possibly be aligned with the production jets issuing from the perforations into the producing formation. The elements are half cylinders of an abrasion resistant material which have mating tongue and groove overlapping axial joints and tongue and groove arcuate end joints which when properly engaged retain the elements in surrounding relation to the tubing and resist large broken pieces of the elements from falling into the well bore. Interengaging support elements are provided at each end of the assembly of protecting rings formed by the elements to support the rings in the desired position, to retain the elements in place by preventing their radial outward movement and to protect the rings from damage by centering the tubing as it is moved through the well bore.

An object of the present invention is to provide an improved tubular structure which is abrasion resistant to abrasive high velocity fluid flows directed toward its exterior surface.

Another object is to provide an improved blast joint in which the abrasion resistant protection rings do not provide any path at their joints which could possibly become aligned with the production jets.

A further object is to provide an improved abrasion resistant half sleeve, two of which form a protection ring for a tubular member, having both axial tongue and groove joints and arcuate end tongue and groove joints.

Still another object is to provide an improved blast joint with protection rings which are so retained on the tubing to resist falling into the well bore even when portions thereof are cracked.

BRIEF DESCRIPTION OF THE DRAWINGS

These and other objects and advantages are hereinafter described and explained with reference to the drawings wherein:

FIG. 3 is a plan view of two of the improved half sleeves forming a protection ring.

FIG. 4 is a sectional view taken along line 4—4 in FIG. 3.

FIG. 5 is a plan view of a pair of support halves assembled together in the position which they are assembled in the improved blast joint with portions broken away to illustrate the fastening of the halves together.

FIG. 6 is a sectional view of the end pieces taken along line 6—6 in FIG. 5.

DESCRIPTION OF THE PREFERRED EMBODIMENTS

Figure 1:
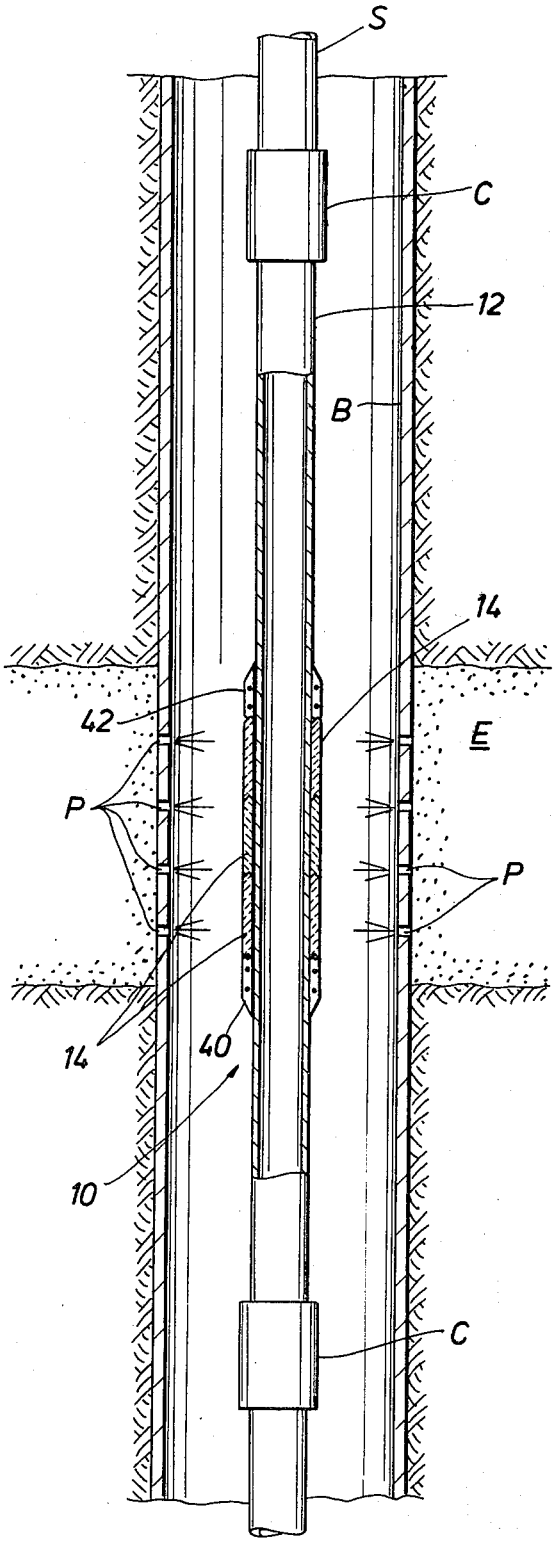
FIG. 1 is a partial sectional view of a production string in a well bore and showing the improved blast joint of the present invention protecting the production tubing in the vicinity of the perforations into the producing formation.
Figure 2:
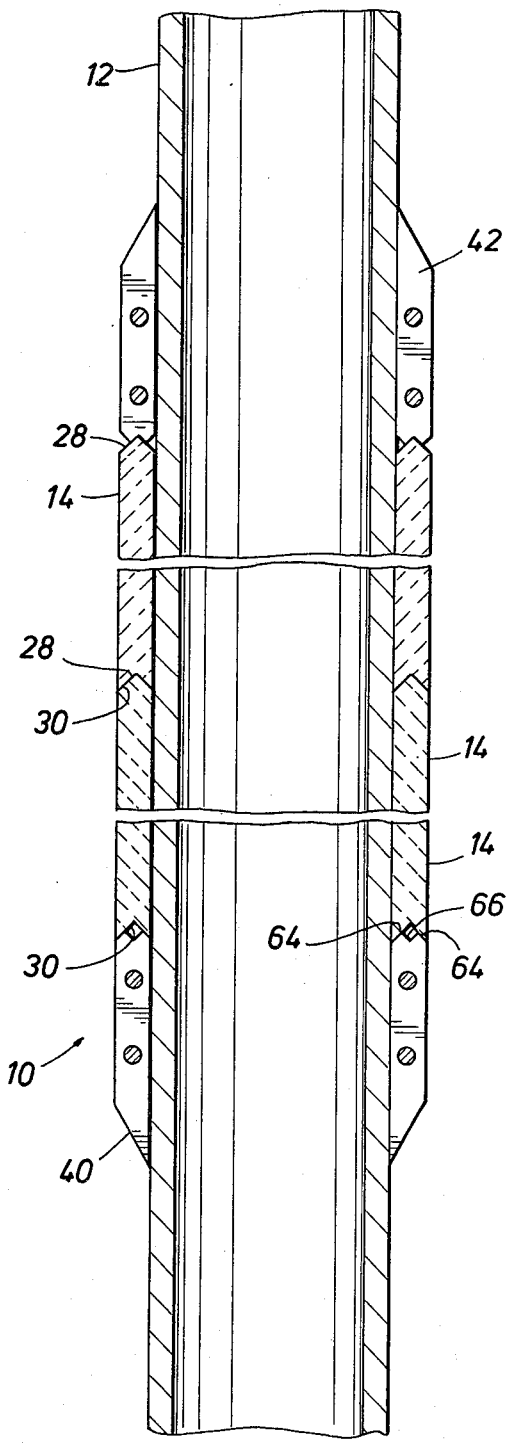
FIG. 2 is a detail sectional view of the improved blast joint of the present invention.

The improved protection structure of the present invention is shown in FIGS. 1 and 2 as blast joint 10 which forms the part of production tubing string S which extends past perforations P in formation E. Blast joint 10 is connected to string S by couplings C.

Blast joint 10 includes tubing 12, a plurality of protection rings 14 and means on the upper and lower ends of rings 14 to support them on tubing 12 which means also functions to retain the engaged portion from moving radially outward and to protect rings 14 by assuring that joint 10 in moving through well bore B is sufficiently centered to avoid impacts on rings 14.

Protection rings 14 are formed of two half sleeves 16 which are shown in greater detail in FIGS. 3 and 4. Half sleeves 16 are identical and include semitubular body 18 with axial edges 20 and 22 and arcuate ends 24 and 26. Arcuate end 24 which is shown is the upper of the two ends and has arcuate projection or annular tongue 28 and arcuate end 26 which, as shown, is the lower of the two ends and has arcuate groove 30. When rings 14 are assembled as shown, projections annular tongues 28 are positioned with grooves 30 of the next higher ring 14 to form a tongue and groove interengage between rings 14. Each half sleeve 16 has a radially outward facing projection or tongue 32 on its edge 20 and a radially outward facing groove 34 immediately inward between projection 32 and body 18 and on its other axial edge 22 radially inward facing projection or tongue 36 and radially inward facing groove 38 immediately inward between projection 36 and body 18. As seen in FIG. 3, when assembled tongue 32 of one half sleeve 16 is positioned in groove 38 of the other half sleeve and tongue 36 of the second half sleeve is positioned in groove 34 of the first half sleeve. The radial distance which tongues 32 and 36 extend into grooves 38 and 34 is preferred to provide an interference which is greater than the diametral clearance between the inner surface of half sleeves 16 and the exterior of the tubular member on which they are installed. For example, half sleeves 16 designed to be installed around a tubular member having an outer diameter of 3.500 inches would have an inner diameter of from 3.531 to 3.621 inches to provide a maximum clearance of 0.121 inches, and a minimum clearance of 0.031 inches and the radial interference between interengaging tongues 32 and 36 is 0.125 inches. With these dimensions, half sleeves 16 are interengaged by sliding into each other while in position around the tubular member. It is also preferred that the outer diameter of rings 14 not exceed the outer diameter of coupling C so that no portion of rings 14 project beyond couplings C thereby preventing impacts on rings 14 during movement in well bore B.

The means supporting, retaining and protecting rings 14 when installed on a tubular member include lower clamping support 40 and upper clamping support 42. Upper support 40 and lower support 42 are preferred to be the same structure and include two identical support halves 44 as best seen in FIGS. 5 and 6. Each support half 44 includes semitubular body 46 and end 48 whose outer diameter tapers from the diameter of body 46 to a diameter slightly greater than the inner diameter of body 46 and end 48 as shown in FIG. 6. Body 46 at one side is provided with threaded bores 50 which extend tangentially through one edge of body 46 and bores 52 which extend tangentially through the other edge of body 46 in a position to align with bores 50 when two of said support halves 44 are assembled to form clamping support 40 or 42. Body 46 includes counterbores 54 surrounding the end of bores 52 to provide shoulders 56 against which heads 58 of bolts 60 seat on tightening support halves 44 to form a clamping support. Arcuate end 62 of body 46 has arcuate projections 64 extending therefrom and forming groove 66 therebetween. With this shape of end 62, clamping supports 40 and 42 interengage with either end of rings 14 to provide an annular tongue and groove engagement of the rings 14 both at their upper and lower ends. Opening 68 is provided in end 48 as shown to allow a rod (not shown) to be inserted therein to assist in tightening all of the rings 14 between supports 40 and 42 to thereby assure the desired tongue and groove engagement of the ends of rings 14 with each other and with supports 40 and 42. Additionally, the upper corners of half sleeves 16 are relieved as at 70 to minimize chipping of half sleeves 16 in handling and assembling.

In assembling the improved blast joint of the present invention, it is preferred to apply a small amount of a suitable bonding agent, such as silicon glue, on the interengaging joints to assist in retaining them in their desired position.

In the preferred form of structure, support halves 44 are metal and are positioned sufficiently above and below the formation jets so that they are not subject to the abrasive action of the jets. In the event that the formation F is producing sour gas, the material of support halves 44 and bolts 60 is selected for its corrosion resistance to the sour gas components.

In the preferred form, the material of half sleeves 16 is a ceramic material such as the nominal 90% $Al_2O_3$ material supplied by Coors Procelain Company of Golden, Colorado under the designation "AD 90". Other abrasion resistance materials, such as tungsten carbide, silicon carbide and boron carbide, are contemplated as being suitable material for half sleeves 16.

What is claimed is:

1. A blast joint for a production tubing string comprising a section of tubing, a plurality of abrasion-resistant rings surrounding the exterior of said tubing section which is to be subjected to the high velocity fluids flowing from a producing formation into the annulus of the well bore through which said tubing section extends, each of said rings including two sections having a semicylindrical body with a first axial edge and a second axial edge, a first inward facing tongue adjacent said first axial edge, a first inward facing groove spaced from said first axial edge by said tongue, a second outward facing tongue adjacent said second axial edge, a second outward facing groove spaced from said second axial edge by said tongue, said sections being assembled to form said rings so that the outward facing tongue of the second edge engages in the inward facing groove of the first edge and the inward facing tongue of the first edge engages in the outward facing groove of the second edge, annular tongue and groove interconnecting means between each of said rings, means secured around said tubing section and interengaging with the lower end of the lower of said rings to retain said ring from outward movement radially away from said tubing section, to support said rings on said tubing section and to protect the lower rings against damage during movement of the tubing section in the well bore, and means secured around said tubing section and interengaging with the upper end of the upper of said rings to retain said ring from outward movement radially away from said tubing section, to retain said rings on said tubing section in engagement with each other and with said lower retaining means and to protect the upper rings against damage during movement of the tubing section in the well bore.

2. A blast joint according to claim 1 including a coupling threaded onto one end of said tubing section, said rings and said upper and lower retaining means having an outer diameter not greater than the diameter of said coupling.

3. A blast joint according to claim 1 wherein said rings have an inner diameter closely fitting around the exterior of said tubing section.

4. A blast joint according to claim 3 wherein said rings have an inner diameter from 0.030 to 0.121 inches larger than the outer diameter of said tubing section and an interference in their axial tongue and groove engagement of at least 0.125 inches.

5. A blast joint according to claim 1 wherein the material of said rings is a ceramic material.

6. A blast joint according to claim 1 wherein the material of said rings is selected from the group consisting of ceramic material, tungsten carbide, silicon carbide and boron carbide.

7. A blast joint according to claim 1 including means for bonding the interengaging portions of said rings together.

8. A blast joint according to claim 1 wherein said rings each include a pair of half sleeves having tongue and groove interengagement along their outer axially extending edges.

9. A blast joint according to claim 8 wherein each of said half sleeves is identical to the other.

10. A blast joint according to claim 8 including means for bonding the interengaging edges of said half sleeves and the interengaging ends of the rings together.

11. As a subcombination for providing abrasion protection to the exterior of a tubular member a protection element comprising a half sleeve of abrasion resistant material having axially extending edges and arcuate ends, one of said ends having a groove therein and the other end having a projection adapted to be received in the end groove of another of said half sleeves, one of said edges having an outward facing projection there along with an outward facing groove spaced from said edge by said projection, the other of said edges having an inward facing projection there along with an inward facing groove spaced from said other edge by said inward facing projection whereby two of said half sleeves interengage in the tongue and grooves along their edges to form a ring with an annular projection on one end and an annular groove on the other end.

12. A protection element according to claim 11 wherein the material of said half sleeve is a ceramic material.

13. A protection element according to claim 11 wherein the material of said half sleeve is selected from the group consisting of ceramic material, tungsten carbide, silicon carbide and boron carbide.

14. A protection element according to claim 12 wherein said ceramic material is a high strength 90 percent $Al_2O_3$ material.

15. A protection structure for a tubular comprising a section of tubing, a plurality of abrasion-resistant rings surrounding the exterior of said tubing section which is to be subjected to the high velocity fluids flowing from a producing formation into the annulas of the well bore through which said tubing section extends, each of said rings including two sections having a semicylindrical body with a first axial edge and a second axial edge, a first inward facing tongue adjacent said first axial edge, a first inward facing groove spaced from said second axial edge by said tongue, the second edge having an outward facing tongue and an outward facing groove spaced from the edge by said tongue, said sections being assembled to form said rings so that the outward facing tongue of the second edge engages in the inward facing groove of the first edge and the inward facing tongue of the first edge engages in the outward facing groove of the second edge, annular tongue and groove interconnecting means between each of said rings, and means secured around said tubing section and interengaging with the lower end of the lower of said rings and the upper end of the upper of said rings to retain said rings from outward movement radially away from said tubing section, to support said rings on said tubing section and to protect the lower and upper rings against damage during movement of the tubing section in the well bore.

16. A protection structure according to claim 15 wherein said rings each include a pair of half sleeves having tongue and groove interengagement along their outer axially extending edges.

17. A protection structure according to claim 16 wherein each of said half sleeves is identical to the other.

18. A protection structure according to claim 15 wherein the material of said rings is selected from the group consisting of ceramic material, tungsten carbide, silicon carbide, and boron carbide.

19. A protective structure according to claim 15 including means for bonding the interengaging portions of said rings together.

20. A protection structure according to claim 15 including means for bonding the interengaging edges of said half sleeves and the interengaging ends of the rings together.

21. A sub-combination of a non-resilient abrasion resistant ring to be assembled on a production string to protect the string from abrasion, said ring comprising two sections, each section having a semicylindrical body with a first axial edge and a second axial edge, a first inward facing tongue adjacent said first axial edge, a first inward facing groove spaced from said first axial edge by said tongue, a second outward facing tongue adjacent said second axial edge, a second outward facing groove spaced from said second axial edge by said tongue, said sections being assembled to form said rings so that the outward facing tongue of the second edge engages in the inward facing groove of the first edge and the inward facing tongue of the first edge engages in the outward facing groove of the second edge, and an annular tongue at one end and an annular groove at the other end of each section.

* * * * *